US008430023B2

(12) United States Patent
Hynes

(10) Patent No.: US 8,430,023 B2
(45) Date of Patent: Apr. 30, 2013

(54) ADJUSTABLE WINE AERATOR

(76) Inventor: India Hynes, Newport Beach, CA (US)

( * ) Notice: Subject to any disclaimer, the term of this patent is extended or adjusted under 35 U.S.C. 154(b) by 225 days.

(21) Appl. No.: 13/029,525

(22) Filed: Feb. 17, 2011

(65) Prior Publication Data

US 2011/0271846 A1 Nov. 10, 2011

Related U.S. Application Data

(60) Provisional application No. 61/331,276, filed on May 4, 2010.

(51) Int. Cl.
*B01F 3/04* (2006.01)

(52) U.S. Cl.
USPC ..... 99/323.1; 99/277.2; 99/277.1

(58) Field of Classification Search ..... 99/323.1, 99/277.2, 277.1; 239/288.5, 561, 560, 428.5
See application file for complete search history.

(56) References Cited

U.S. PATENT DOCUMENTS 1,256,243 A * 2/1918 Maul ..... 239/556
1,717,887 A * 6/1929 Noack ..... 239/553.3
2,603,469 A * 7/1952 Bedford et al. ..... 261/116
2,941,729 A * 6/1960 Goodrie ..... 239/428.5
2,950,063 A * 8/1960 Ripley, Jr. ..... 239/428.5
3,058,670 A * 10/1962 Marotto et al. ..... 239/428.5
3,092,334 A * 6/1963 Peterson ..... 239/516
3,304,865 A * 2/1967 Gungle ..... 239/265.11
3,917,172 A * 11/1975 O'Hare ..... 239/305
4,095,747 A * 6/1978 Anderson ..... 239/288.5
4,187,986 A * 2/1980 Petrovic ..... 239/449
4,272,022 A * 6/1981 Evans ..... 239/107
4,941,616 A * 7/1990 Liebler ..... 239/310
5,199,639 A * 4/1993 Kobayashi et al. ..... 239/11
5,316,216 A * 5/1994 Cammack et al. ..... 239/71
5,381,959 A * 1/1995 Malkin ..... 239/201
5,433,384 A * 7/1995 Chan et al. ..... 239/449
5,476,225 A * 12/1995 Chan ..... 239/449
6,145,757 A * 11/2000 Knapp ..... 239/443
6,367,710 B2 * 4/2002 Fan ..... 239/99
6,412,711 B1 * 7/2002 Fan ..... 239/446
6,622,945 B1 * 9/2003 Wu et al. ..... 239/443
6,647,566 B1 * 11/2003 Wang ..... 4/615
6,981,661 B1 * 1/2006 Chen ..... 239/532
7,032,838 B2 * 4/2006 Fan ..... 239/288.5
7,344,094 B1 * 3/2008 Tracy et al. ..... 239/588
7,374,366 B2 * 5/2008 Tasi ..... 405/79
7,540,330 B2 * 6/2009 Orr et al. ..... 169/37
7,594,616 B2 * 9/2009 Hupp ..... 239/570
7,624,813 B2 * 12/2009 Ma ..... 169/37
7,654,470 B2 * 2/2010 Crosswell ..... 239/150
7,677,473 B2 * 3/2010 Kao ..... 239/428.5
7,731,107 B2 * 6/2010 Grether ..... 239/500
7,766,259 B2 * 8/2010 Feith et al. ..... 239/391

(Continued)

*Primary Examiner* — Joseph M Pelham
*Assistant Examiner* — Jimmy Chou
(74) *Attorney, Agent, or Firm* — Kleinberg & Lerner, LLP; Marvin H. Kleinberg; Marshall A. Lerner

(57) ABSTRACT

An aerator for fluids, such as wine, includes an upper bowl portion with a set of openings in the base, a restrictor plate with, in the preferred embodiment, three sets of apertures. Each of the restrictor plate aperture sets can be aligned with the bowl openings to provide three different flow rates. A collar portion selects the aperture set to be aligned and includes vents to permit air into a central flow path wherein the wine is aerated as it flows through the collar portion.

17 Claims, 6 Drawing Sheets

U.S. PATENT DOCUMENTS

| | | | | |
|---|---|---|---|---|
| 7,770,614 | B2 * | 8/2010 | Ben Shlomo et al. | 141/344 |
| 7,913,932 | B2 * | 3/2011 | Wu | 239/288.5 |
| 8,177,147 | B2 * | 5/2012 | Engel | 239/443 |
| 8,205,810 | B2 * | 6/2012 | Lacher et al. | 239/428.5 |
| 8,220,726 | B2 * | 7/2012 | Qiu et al. | 239/449 |
| 2004/0199995 | A1 * | 10/2004 | Bui | 4/676 |
| 2005/0156062 | A1 * | 7/2005 | Thomas et al. | 239/548 |
| 2006/0237563 | A1 * | 10/2006 | Hupp | 239/556 |
| 2006/0273201 | A1 * | 12/2006 | Wu | 239/394 |
| 2006/0273203 | A1 * | 12/2006 | Denzler | 239/428.5 |
| 2007/0176024 | A1 * | 8/2007 | Denzler | 239/428.5 |
| 2007/0256568 | A1 * | 11/2007 | Nudi et al. | 99/275 |
| 2008/0099094 | A1 * | 5/2008 | Loong | 138/43 |
| 2008/0156902 | A1 * | 7/2008 | Luettgen et al. | 239/447 |
| 2008/0190517 | A1 * | 8/2008 | Ben Shlomo et al. | 141/331 |
| 2008/0289097 | A1 * | 11/2008 | Jeong | 4/615 |
| 2009/0114743 | A1 * | 5/2009 | Thomas et al. | 239/428.5 |
| 2009/0126099 | A1 * | 5/2009 | Holtsnider | 4/541.6 |
| 2009/0166450 | A1 * | 7/2009 | Kao | 239/428.5 |
| 2010/0025867 | A1 * | 2/2010 | Benton et al. | 261/110 |

* cited by examiner

Fiigure 6b

ADJUSTABLE WINE AERATOR

This is a Continuation-in-Part of my Provisional Application Patent Ser. No. 61/331,276, filed May 4, 2010.

BACKGROUND OF THE INVENTION

1. Field of the Invention

The present invention relates to wine accessories and, more particularly, to an aerating pourer that enhances the drinkability of a wine as it is being transferred from the bottle to a wine glass.

2. General Background and State of the Art

It is well known that wine can be improved by decanting which allows the retention of sediment in the bottle and provides some aeration of the wine prior to being served. In recent years, accessory pourers which fit into the bottle, have permitted aeration as the wine is being transferred from the bottle to a wine glass. In general, these accessories have included a globular section between the bottle and the pouring spout in which the wine experiences a turbulent flow.

INVENTION SUMMARY

Broadly, an embodiment of the present invention generally provides a device for selectively aerating wine. The device comprises a funnel-shaped aerating top section, a grippable mid-section funnel part and a bottom funnel stem. Each section may have an inner channel. Air may be admitted to the inner channel of the device at the top section.

In the preferred embodiment, the top portion has a set of apertures in the base. A rotatable plate has sets of orifices, each set a different size. The plate can be rotated so that only one set of orifices is aligned with the top portion apertures. The rate of flow can then be chosen by aligning the apertures with a selected set of orifices. In alternative embodiments, a large aperture can be selectively occluded to regulate the flow of wine.

BRIEF DESCRIPTION OF THE DRAWINGS

FIG. 4 including

FIG. 5, including FIG. 6, including FIGS. 6*a*, 6*b*, 6*c* and 6*d* show a front view, an exploded view and sectional views of yet another embodiment of the invention.

DETAILED DESCRIPTION OF THE PREFERRED EMBODIMENTS

Figure 1:
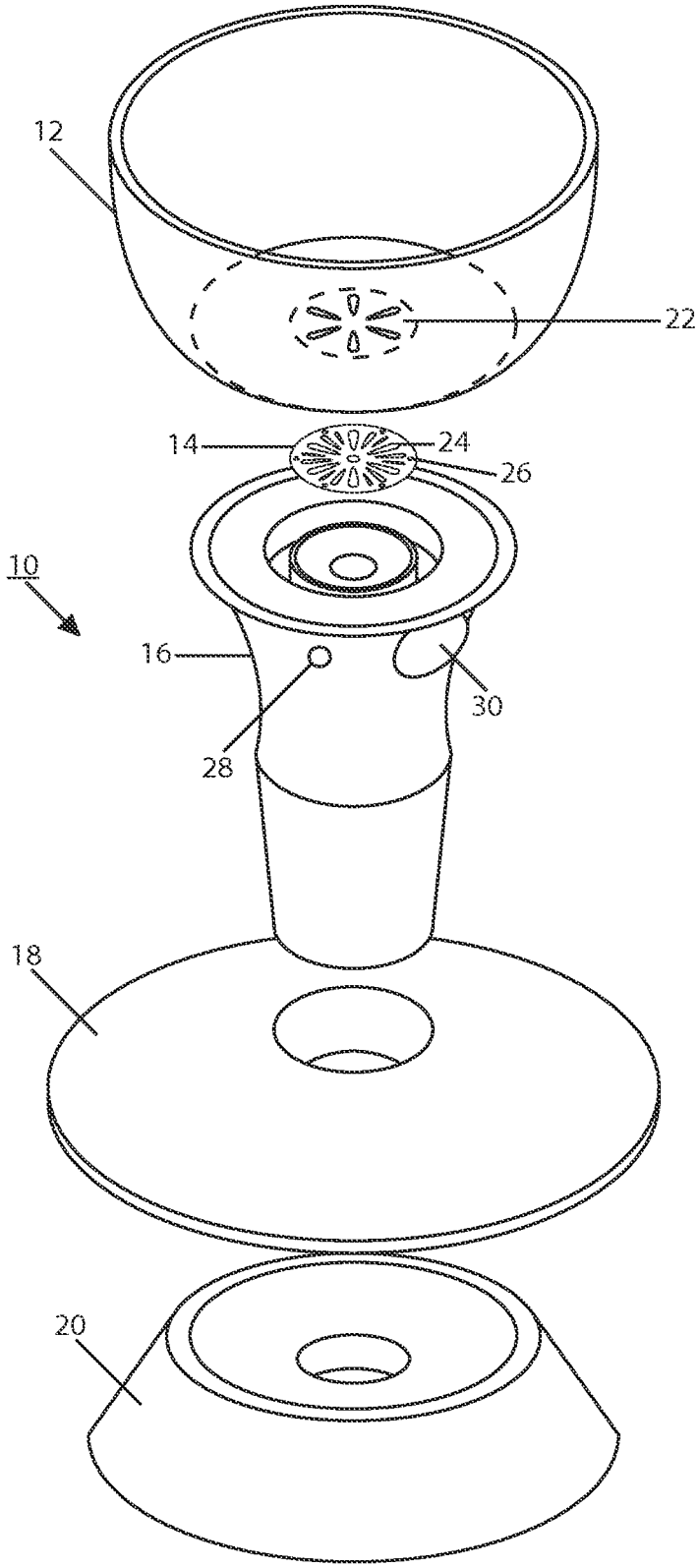
FIG. 1 is an exploded perspective view of an aerator according to a preferred embodiment of the invention.

Turning first to FIG. 1, there is shown an exploded view of an aerator 10 according to the present invention. Included is a bowl portion 12, a flow restricting occluding disc 14, a rotatable aerator sleeve 16 which carries the disc 14, a support plate 18 and a stand 20 in which to hold the aerator 10 when not in use. The bowl 12 has, at the bottom of the interior surface, a plurality of shaped apertures 22 through which the wine flows when in use as an aerator.

The disc 14 has, in the preferred embodiment, three sets of openings 24 each of a different size. Two of the sets are smaller than the apertures 22 in the bowl 12 and, in one set, the openings are approximately equal to the apertures 22. The disc 14 also has a set of driving apertures 26 which cooperate with pins on the sleeve 16 which engage the driving apertures 26 to rotate disc 14. In a first orientation, the largest openings 24 are aligned with the bowl apertures 22 for maximum flow. In a second orientation, medium sized openings 24' are aligned with the bowl apertures 22 for a medium rate of flow. When the smallest openings 24" are aligned with the bowl apertures 22, the flow is the slowest.

The sleeve 16 includes a pair of opposed aerating apertures 28 through which air is admitted to the flow path and is mixed into the flowing wine. The sleeve 16 also includes a release button 30 which allows the sleeve 16 to be disengaged from the bowl 12. By rotating the sleeve 16, the disc 14 is also rotated and a flow rate can be selected by the alignment of the disk openings 24 with the bowl apertures 22.

The combination of apertures 22 and openings 24 cause the wine to flow is separate streams into the interior of the sleeve 16 These streams can mix with the air until they combine into a single stream. When a slow flow rate is selected, the wine is in the aerator for a longer period of time, allowing more air to mix into the stream. With a faster flow rate, less air is mixed and entrained. Accordingly, for wines that need greater aeration, a slower flow rate is selected and for wines needing little aeration, the fastest slow rate is chosen.

Figure 2:
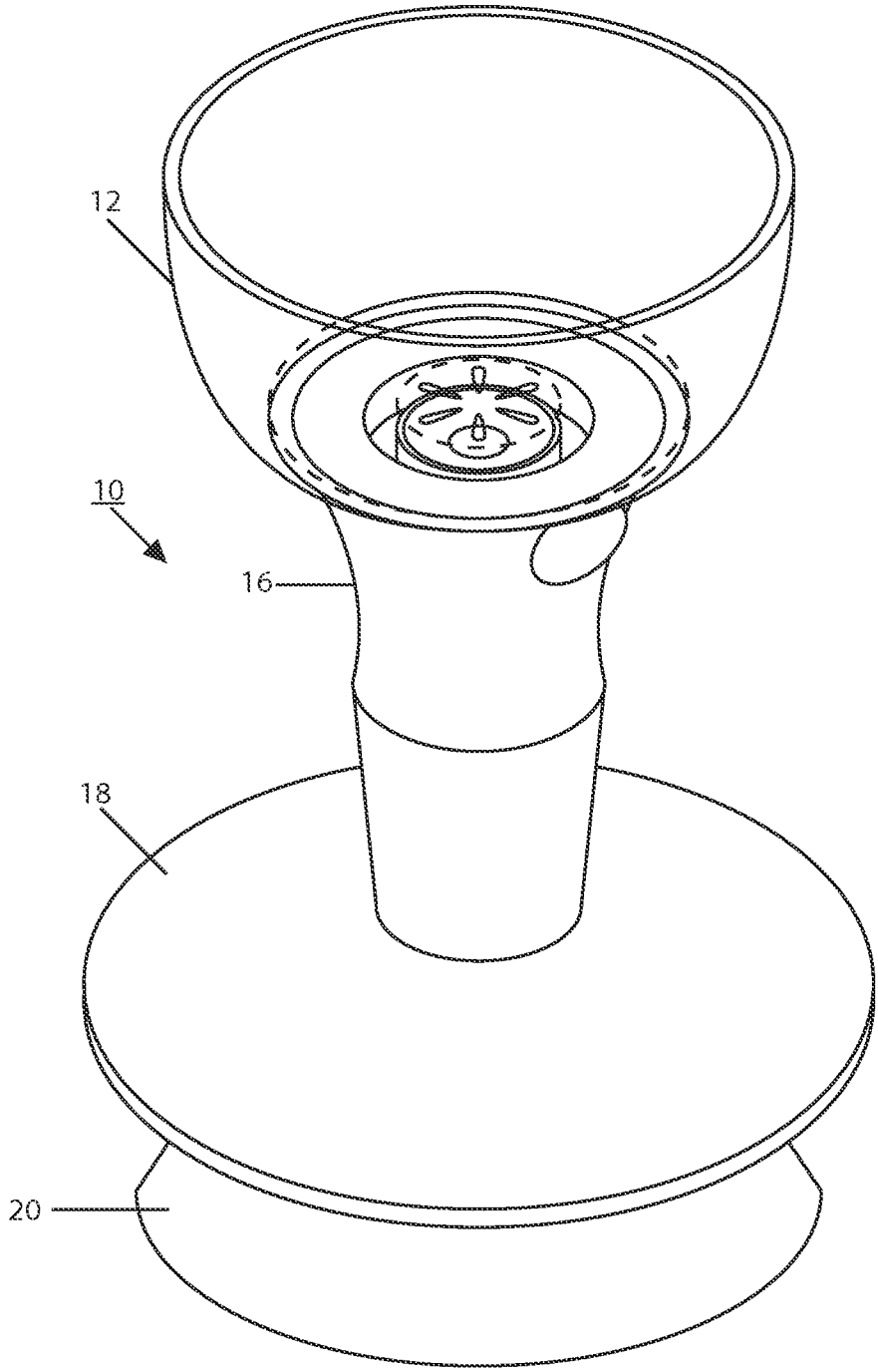
FIG. 2 is a perspective view of the aerator of FIG. 1 assembled for use.

The assembled aerator 10 is shown in FIG. 2. but not all parts can be shown. The assembled aerator 10 includes the bowl 12 the sleeve 16, the support plate 18 and the stand 20. In FIG. 2, the apertures 22 are aligned with the largest openings 24 for maximum flow.

Figure 3:
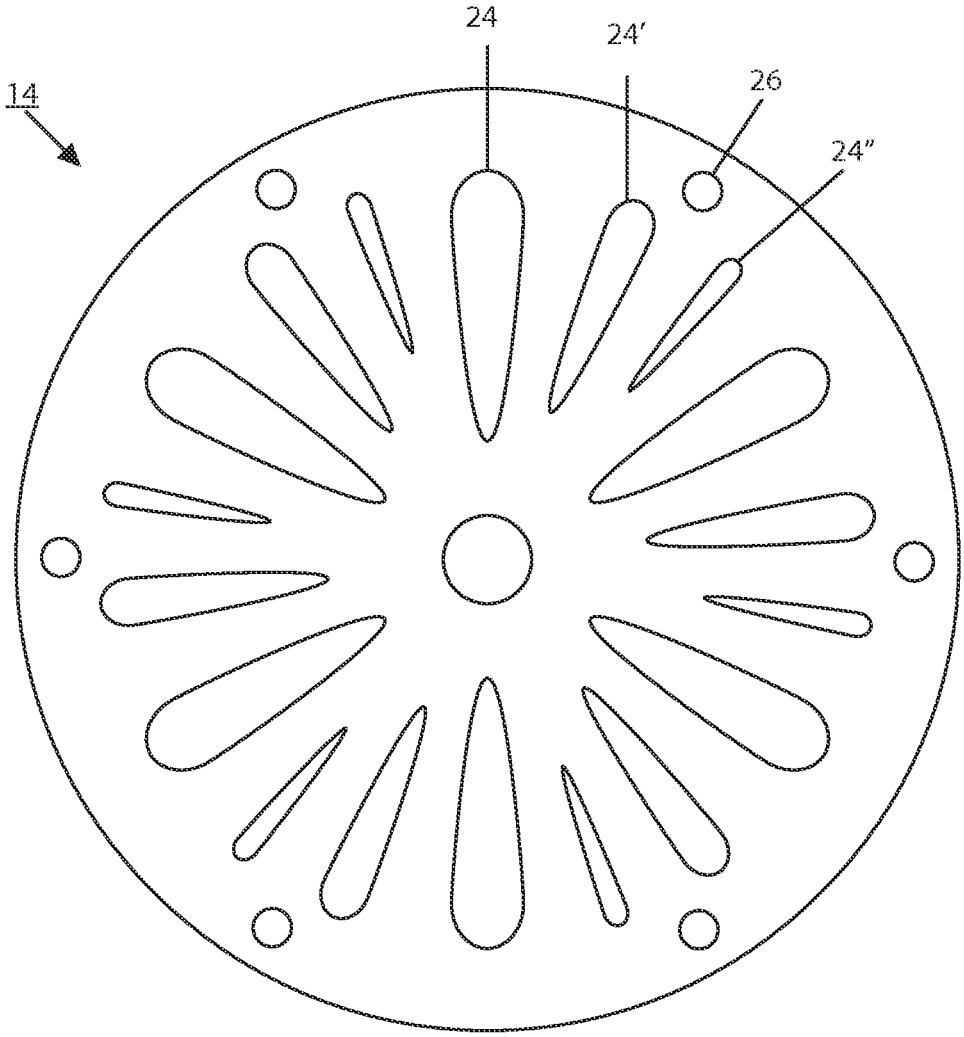
FIG. 3 is a top view of the aerator plate of the aerator of FIG. 1.

In FIG. 3, the aerator disc 14 is shown in greater detail. As shown, three sets of openings 24, 24' and 24" provide selectable sized openings through which wine can flow. Pins engage the driving apertures 26 to rotate the disc. By rotation, the disc 14 can selectively align openings 24, 24' 24" with the bowl apertures (best seen in FIGS. 1 and 2

In use, the support plate 18 is placed over a wine glass and the aerator 10 is placed in the support plate 18. The sleeve 16 is rotated to select an appropriate alignment of openings 24 and apertures 22 for the wine to be aerated. The wine is then poured into the bowl portion 12. As the wine goes through the aperture 22 opening 24 combination, it exits in separated streams which pass through the air filled fluid flow path of the sleeve 16. The flow can be somewhat turbulent and air will be mixed with the wine. The separate streams combine and exit the aerator into the waiting wine glass.

According to exemplary embodiments of FIGS. 4, 5 and 6, the device 110, 110', 110", respectively, may comprise a funnel-shaped top section 112, 112', 112" which may have an internal plate 114, 114' 114' with aerating holes 124, 124' 124". Aerating ports 128, 128', 128", which may be spaced around the lower end of the top section 112, 112', 112", may admit oxygen-containing air from the atmosphere into the top section 112, 112' 112" (FIGS. 4*c*, 5*c* and 6*c*). These embodiments of the device also comprise a grippable mid-section sleeve 118, 118', 118" into which the top section 112, 112', 112" may be fitted. The mid-section sleeve 118, 118' 118" may be attached to a funnel-shaped bottom section 132, 1332', 132' of the device. The bottom funnel section 132, 132', 132" may also include an upper internal disc 114, 114' 114" with aerating holes 124, 124', 124" (FIGS. 4*b*, 5*b* and 6*b*).

The device can comprise various features that can adjust the amount of aeration for wine being poured into the top aerating funnel section 112, 112', 112" and through the inner channel of the assembled device.

Figure 4A:
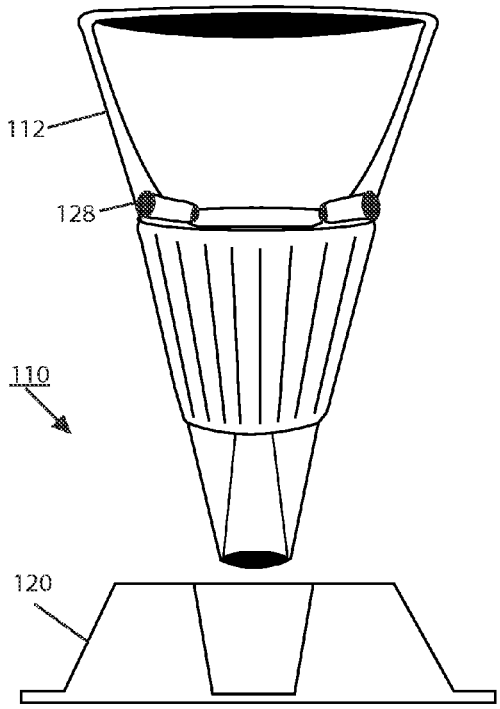
FIGS. 4*a*, 4*b* 4*c* and 4*d* show a front view, an exploded view and sectional views of an aerator according to a first alternative embodiment of the invention.
Figure 4B:
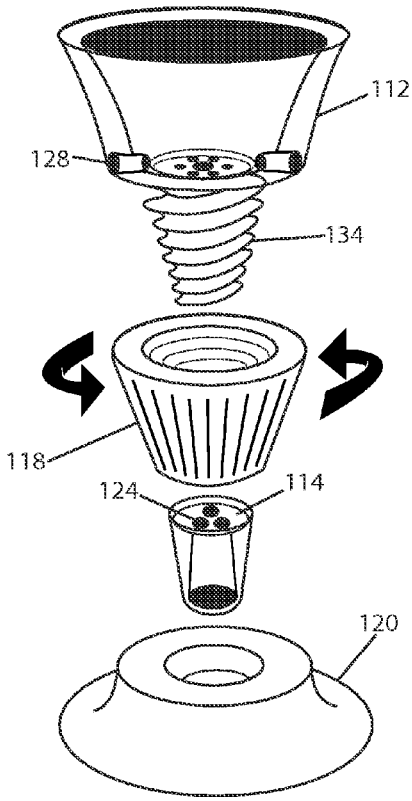
Figure 4C:
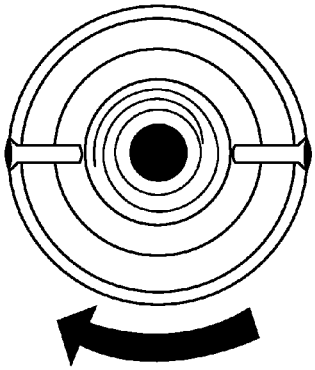
Figure 4D:
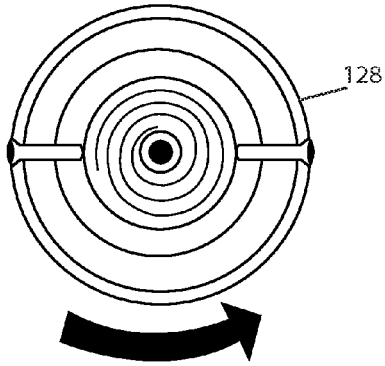
Figure 5A:
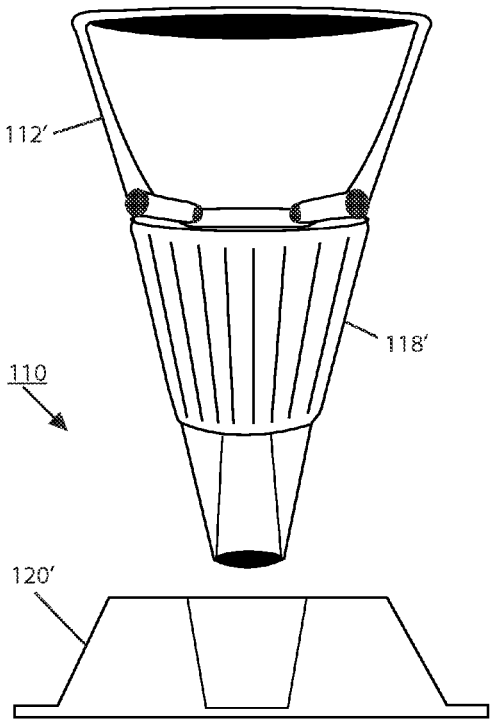
FIGS. 5*a*, 5*b*, 5*c* and 5*d* show a front view, an exploded view and sectional views of another embodiment of the invention.
Figure 5B:
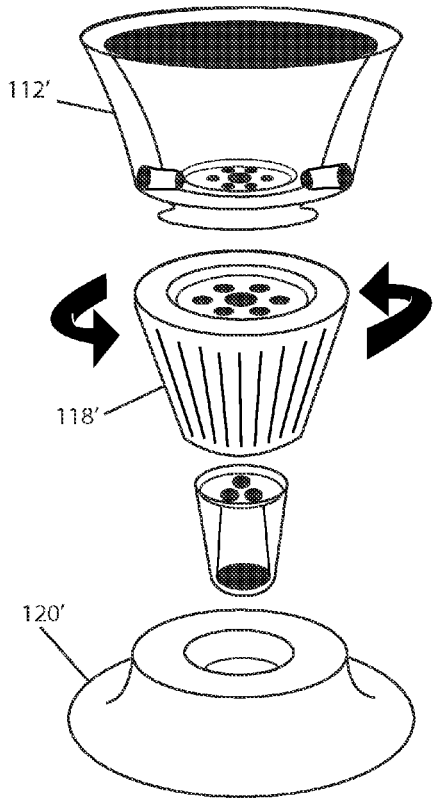
Figure 5C:
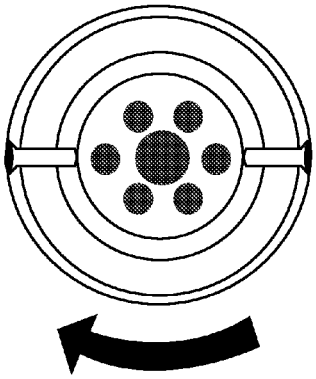
Figure 5D:
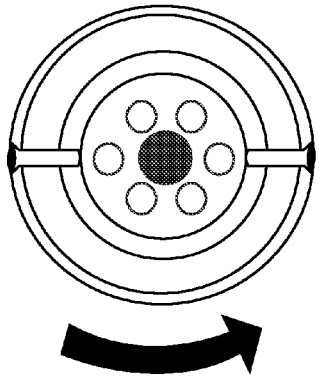

According to one exemplary embodiment (FIGS. 4*a*, 4*b*, 4*c* and 4*d*) the device may be a swirl aerator comprising a funnel-shaped top section 112 having an aerating threaded projection 134 below the internal disc 114 with aerating holes 124. In this embodiment, the top funnel section 112 and mid-section funnel 132 of the device may be connected, by mating the threaded projection 134 of top swirl funnel 112 (male) to the threaded interior of mid-section funnel shaped bottom portion 132 (female) (FIG. 4*b*). The amount of oxygen to which the wine is exposed while being poured may be adjusted by gripping and twisting the mid-section funnel portion 132 to loosen or tighten the threaded connection between the threaded projection of top swirl funnel and the threaded mid-section swirl funnel (FIGS. 4*c* and 4*d*).

In another exemplary embodiment (FIGS. 5*a*, 5*b*, 5*c* and 5*d*) the device may be a knob aerator comprising a mid-section collar part 118' having an internal plate 136 with aerating holes 138. According to this embodiment, the amount of oxygen to which the decanted wine is exposed may be controlled by twisting the midsection 118' so that the aerating holes 138 are increased or decreased in size (FIGS. 5*c* and 5*d*) and thereby allowing a greater or lesser flow of wine through the device.

Figure 6A:
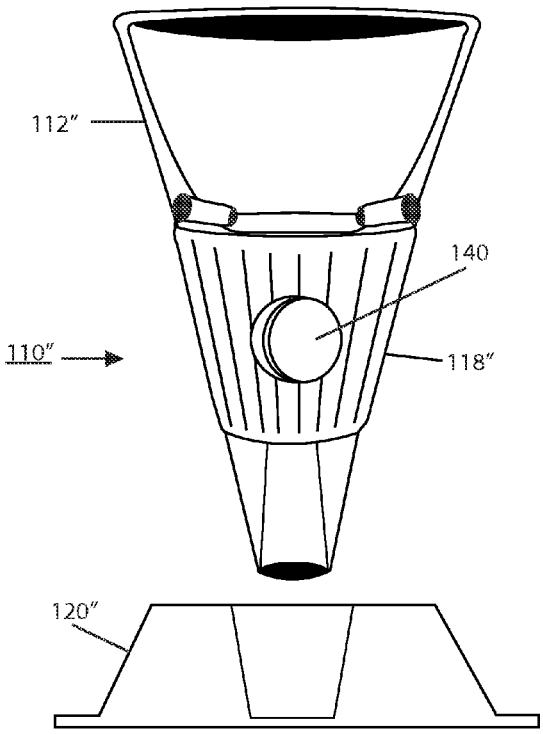
Figure 6A:
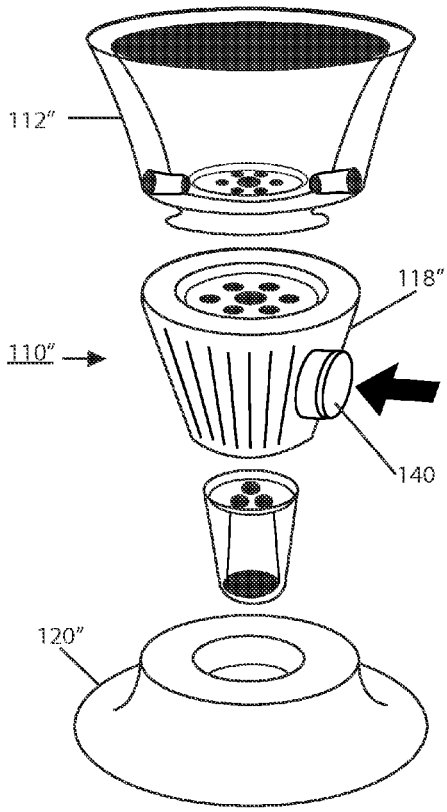
Figure 6C:
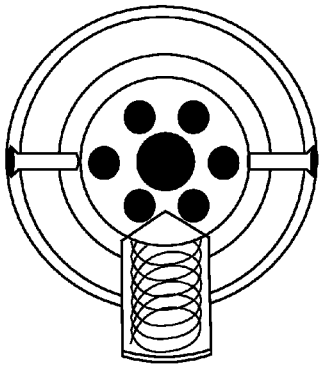
Figure 6D:
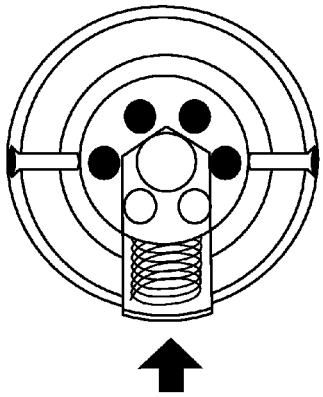

In yet another exemplary embodiment, (FIGS. 6*a*, 6*b*, 6*c* and 6*d*) the device 110" may be a push button aerator comprising a mid-section part 118" with a pushable button 140 that when pressed, may extend into the mid-section part 118" so that some of the aerating holes are closed, decreasing the amount of aeration of the wine passing through the device (FIGS. 6*c* and 6*d*).

In all of the above embodiments, the ports 128, 128', 128" may admit a constant flow of oxygen-containing air to aerate and dispense the decanted wine. Other modifications of the device can be made as long as the device retains its adjustable properties that may allow the user to select the amount of aeration of the decanted wine.

To use the device, a bottle of wine can be uncorked, and depending on the type of wine, either white or red, and the variety, the degree of aeration desired may be selected by adjusting the threaded mid-section collar 118, 118', 118" or the aerating holes 138. The degree of twisting or opening of the holes of the mid-section may be determined by experience, or by consulting a chart provided with the device. The wine may then be decanted through the device into a receptacle.

When not in use, the device can be placed in a base stand 120. The aerator should be rinsed/cleaned between uses. By its adjustable nature, the adjustable aerator is specially designed for aerating both red and white wines. (Since current aerators are generally designed for one or the other, usually red wines).

It should be understood, of course, that the foregoing relates to exemplary embodiments of the invention and that modifications may be made without departing from the spirit and scope of the invention as set forth in the following claims.

The invention claimed is:

1. An aerating apparatus comprising:

a. a bowl portion having, at its base, a set of openings through which liquids may flow;

b. a flow restrictor plate adjacent said set of openings and having at least two sets of apertures, the apertures of each set being similarly sized;

c. sleeve means including restrictor plate driving means said sleeve means including a fluid flow path and being adapted to connect to the base of said bowl portion to provide a fluid flow path through the interior of said sleeve means; and d. venting means in said sleeve means for admitting air to said fluid flow path;

whereby rotation of said sleeve means causes a selected set of apertures to be aligned with said bowl openings dividing the fluid into separate streams which are aerated before combining in said flow path.

2. The apparatus of claim 1 wherein the number of openings in said bowl portion is equal to the number of apertures in said restrictor plate.

3. The apparatus of claim 1 wherein said restrictor plate has three sets of apertures wherein one set is larger than the other two and one set is smaller than the other two.

4. The apparatus of claim 1, further including a support plate adapted to rest on a drinking receptacle and to receive said bowl portion and sleeve means wherein fluid introduced into said bowl portion traverses said apparatus and is deposited into the drinking receptacle.

5. The apparatus of claim 1, further including a support stand adapted to receive said sleeve means when the apparatus is not being used to aerate fluids.

6. A wine-aerating device, comprising:

a. a top funnel part;

b. a mid-section funnel part; and c. a bottom funnel part;

wherein said top funnel part includes inner aerating holes and said mid-section funnel part includes an aerating structure including side aerating holes and means to selectively adjust the degree of aeration, whereby when the funnel parts are attached to one another and the degree of aeration in said mid-section funnel part is selected, wine introduced into said top funnel part and passing through the device is aerated.

7. An aerating apparatus comprising:

a. a bowl portion having, at its base, a set of openings through which liquids can flow;

b. a flow restrictor plate adjacent said set of openings and having at least two sets of apertures, the apertures of each set being similarly sized;

c. collar means including restrictor plate driving means, said collar means including a fluid flow path and being adapted to connect to the base of said bowl portion to provide a fluid flow path through the interior of said collar means; and d. venting means in said collar means for admitting air to said fluid flow path;

whereby rotation of said collar means activates said plate driving means to cause a selected set of apertures to be aligned with said bowl openings, dividing the fluid into separate streams which are aerated before combining in said fluid flow path.

8. The apparatus of claim 7 wherein the number of openings in said bowl set is equal to the number of apertures in each said restrictor plate set.

9. The apparatus of claim 7 wherein said restrictor plate has three sets of apertures wherein one set is larger than the other two and one set is smaller than the other two.

10. The apparatus of claim 7, further including a support collar adapted to rest on a drinking receptacle and to receive said bowl and collar means wherein fluid introduced into said bowl traverses said apparatus and is deposited in the drinking receptacle.

11. The apparatus of claim 7, further including a support stand adapted to receive said collar means when the apparatus is not being used to aerate fluids.

12. Fluid aerating apparatus comprising:

a. fluid receiving means including a base portion with a plurality of openings;

b. flow restricting means including a restrictor plate with at least two sets of apertures, each set having said plurality of apertures, the apertures of one set being larger than the apertures of the other set;

c. collar means coupled to said fluid receiving means and including a central flow path and driving means connected to said flow restricting means for aligning one set of apertures with said base portion openings; and d. venting means in said collar means for admitting air into said central flow path;

whereby said flow restricting means divides fluid in said receiving means into a plurality of streams which are combined in the presence of air in said central flow path, thereby aerating the fluid passing therethrough.

13. The fluid aerating apparatus of claim 12, above, wherein said flow restricting means includes three sets of apertures, the apertures of one set of which is smaller than the apertures of the other sets.

14. The fluid aerating apparatus of claim 12 above, further including a plate with a central opening, said plate being adapted to rest on a fluid container and to receive said collar means whereby fluid added to said fluid receiving means passes through said flow restricting means, is aerated in said collar means and flows into said fluid container.

15. A fluid aerating apparatus including:

a. bowl means for receiving fluid to be aerated;

b. flow restricting means for selectively controlling the flow rate of fluid exiting said bowl means; and c. aerating means adjacent said bowl means and said flow restricting means for introducing air into the fluid exiting said flow restricting means; wherein said selecting means can alternatively set three rates of flow, one rate being faster than the others and one rate being slower than the others.

16. The fluid aerating apparatus as in claim 15 above wherein said flow restricting means include selecting means for setting a fluid flow rate out of said restricting means.

17. The fluid aerating apparatus as in claim 15 above wherein said selecting means alternatively set a slower and a faster fluid flow rate.

* * * * *